United States Patent [19]

Takahashi et al.

[11] Patent Number: 4,791,454

[45] Date of Patent: Dec. 13, 1988

[54] REMOVABLE PHOTOCONDUCTIVE ELEMENT UNIT FOR IMAGE-FORMING APPARATUS

[75] Inventors: Sadao Takahashi, Tokyo; Tsuyoshi Deki, Yokohama, both of Japan

[73] Assignee: Ricoh Company, Ltd., Tokyo, Japan

[21] Appl. No.: 58,854

[22] Filed: Jun. 5, 1987

[30] Foreign Application Priority Data

Jun. 5, 1986 [JP] Japan ..... 61-129108
Jun. 5, 1986 [JP] Japan ..... 61-129109
Jul. 21, 1986 [JP] Japan ..... 61-110659[U]

[51] Int. Cl.[4] ..... G03G 21/00
[52] U.S. Cl. ..... 355/15; 355/3 BE
[58] Field of Search ..... 355/15, 3 DR, 3 BE, 355/3 R

[56] References Cited

U.S. PATENT DOCUMENTS 4,386,838 6/1983 Hirabayashi et al. ..... 355/3 DR
4,403,851 9/1983 Yanagawa ..... 355/3 BE
4,462,677 7/1984 Onoda ..... 355/3 R
4,634,264 1/1987 Takahashi ..... 355/3 BE
4,657,370 4/1987 Forbes et al. ..... 355/3 BE

*Primary Examiner*—R. L. Moses
*Attorney, Agent, or Firm*—Oblon, Fisher, Spivak, McClelland & Maier

[57] ABSTRACT

A photoconductive element unit removably mounted in an electronic copier or like image-forming apparatus and having a single casing in which a photoconductive element, and a cleaning device made up of a cleaning means and a toner collecting container are accommodated. The cleaning device is removably mounted in the unit. The container is provided with an opening for producing toner which is collected in the container. Usually, a closure member is plugged in the opening to close it.

15 Claims, 6 Drawing Sheets

REMOVABLE PHOTOCONDUCTIVE ELEMENT UNIT FOR IMAGE-FORMING APPARATUS

BACKGROUND OF THE INVENTION

The present invention relates to a photoconductive element unit which is removably mounted in an image-forming apparatus.

Many of modern electronic copiers, electrostatic copiers, facsimile apparatus, and other image-forming apparatus of the type using a belt for a photoconductive element are furnished with a removable photoconductive element unit. Specifically, the photoconductive element unit includes a belt which is passed over a drive roller and driven rollers, and a cleaning device made up of a cleaning means for removing toner which remains on the belt after image transfer and a container for collecting the removed toner. A single housing which accommodates the belt and the cleaning device therein is removably mounted in the image-forming apparatus and may readily be replaced with another by the hand.

A prior art photoconductive element unit of the type described is not designed to allow the cleaning device, which consists of the cleaning means and container as stated above, to be removed from the unit for replacement. Also, the container is hermetically closed so that the toner collected therein cannot be taken out to be disposed of. However, due to the increase in the life of a photoconductive element which owes to the recent progress of technology, it is getting difficult to collect in the container the whole amount of toner which may be removed from the belt before the life of the belt expires. In addition, a cleaning blade, a fur brush and others which serve as a toner collecting means become unusable due to aging before the expiration of the life of the belt.

Therefore, a problem with the prior art photoconductive element unit is that, because the cleaning device cannot be removed and because the toner once collected in the container cannot be taken out, the whole unit inclusive of the belt has to be replaced when the container becomes full or when the cleaning means becomes unusable, even if the belt is still usable. When the belt is scratched or otherwise damaged, too, the unit has to be disposed of with the cleaning device contained therein. Such not only wastes limited resources but also increases the running cost of the aparatus. A container capable of accommodating the whole amount of toner throughout the life of the belt would be too great in dimensions to be accommodated in a limited space available in the apparatus.

SUMMARY OF THE INVENTION

It is therefore an object of the present invention to provide a photoconductive element unit for an image-forming apparatus which constitutes a single unit integrally with a toner cleaning device and can be removably mounted in the image-forming apparatus and, yet, prevents the service life of a photoconductive element thereof from being limited by that of the cleaning device.

It is another object of the present invention to provide a photoconductive element unit for an image-forming apparatus which constitutes a single unit integrally with a toner cleaning device and can be removably mounted in the image-forming apparatus and, yet, frees the life of its photoconductive element from the limitation otherwise improved by the limited volume of a toner collecting container of the cleaning device.

It is another object of the present invention to provide a generally improved photoconductive element unit for an imageforming apparatus.

A photoconductive element unit removably mounted in an image-forming apparatus of the present invention comprises a rotatable photoconductive element, and a cleaning device comprising a cleaning means for removing a developer which remains on the photoconductive element after transfer of an image, and a developer collecting means for collecting the developer which is removed by the cleaning means. The cleaning means is removably mounted in the photoconductive element unit.

The above and other objects, features and advantages of the present invention will become more apparent from the following detailed description taken with the accompanying drawings.

DESCRIPTION OF THE PREFERRED EMBODIMENTS

Figure 1:
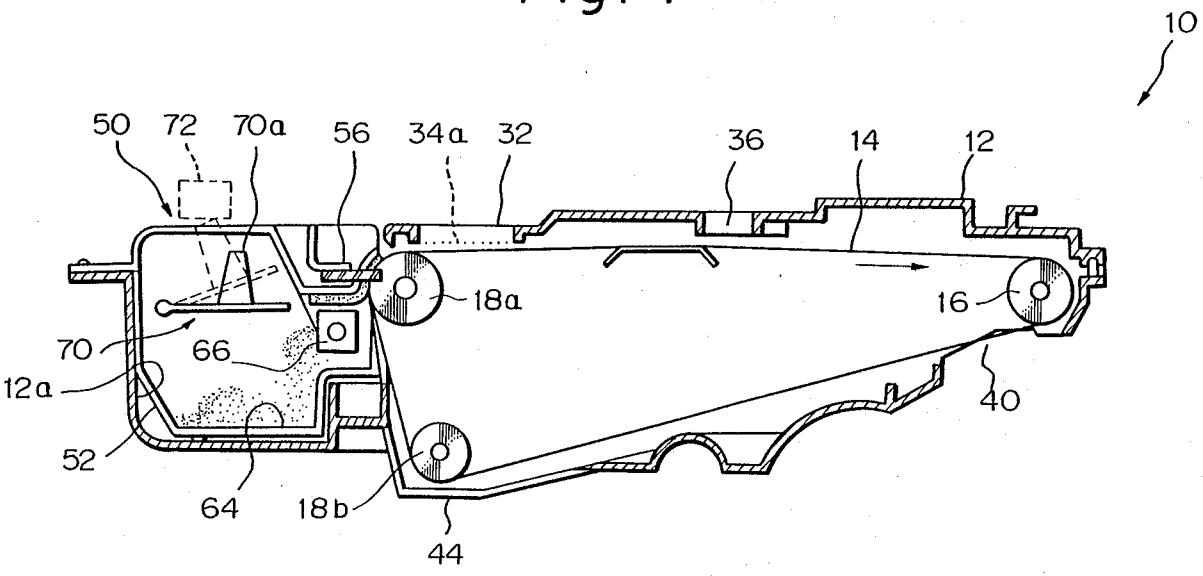
FIG. 1 is a section of a photoconductive element unit embodying the present invention.

Referring to FIG. 1 of the drawings, a photoconductive element unit in accordance with the present invention is shown and generally designated by the reference numeral 10. As shown, the photoconductive element unit 10 comprises a casing 12 which accommodates a photoconductive element in the form of a belt 14 therein. The belt 14 is passed over a drive roller 16 and driven rollers 18*a* and 18*b*. The drive roller 16 is operatively connected to a drive section of a copier, which belongs to a family of image-forming apparatus, so as to rotate the belt 14 in a direction indicated by an arrow. The casing 12 is provided with openings in predetermined portions thereof so that, when the unit 10 is mounted in a copier body 20, FIG. 2, the belt 14 may make contact through those windows with various units of the copier, which are to implement an electrophotographic process. While the belt 14 is held in contact with such units of the copier, a predetermined sequence of operations are performed to provide a toner image on the belt 14 and, then, transfer it to a paper.

Figure 2:
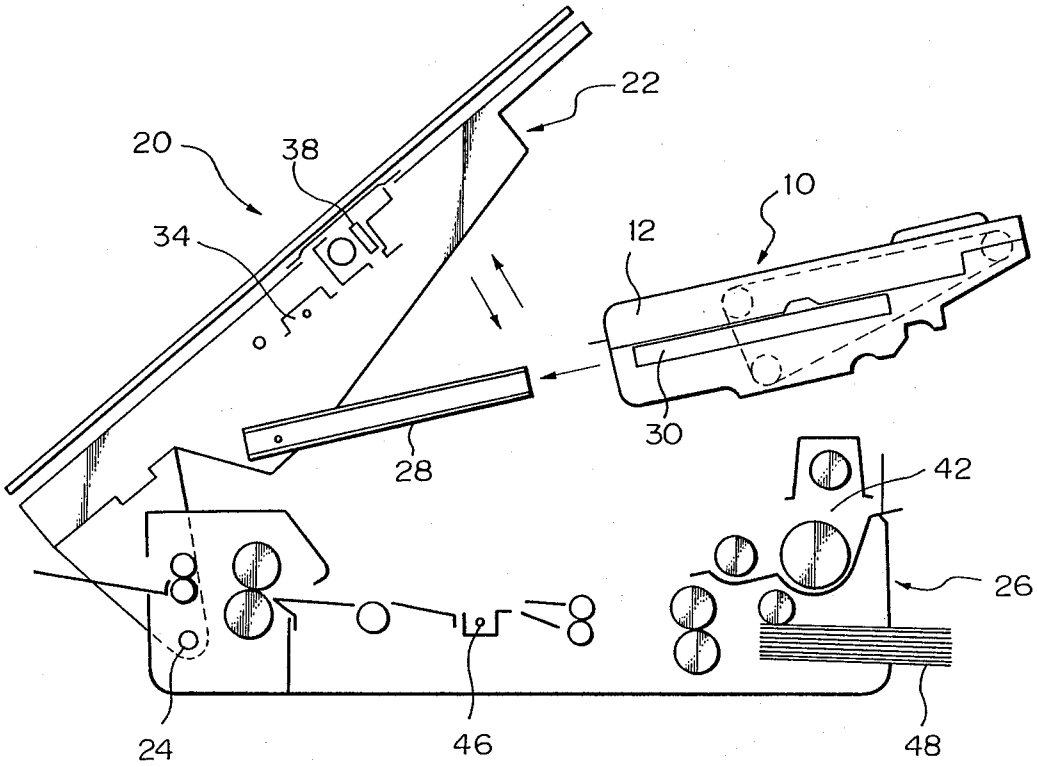
FIGS. 2 and 3 are sections showing, respectively, the unit of FIG. 1 in a position about to be loaded in an image-forming apparatus and a position loaded in the apparatus.

As shown in FIG. 2, the copier body 20 is made up of an upper unit 22 and a lower unit 26. To mount the photoconductive element unit 10 in the copier body 20, the upper unit 22 is rotated counterclockwise about a hinge 24 which is provided at the leftmost end of the lower unit 26. In this condition, the photoconductive element unit 10 is put into the copier body 20 through the wide opening which is defined between the copier upper and lower units 22 and 26 at the right end of the copier body 20. While the unit casing 12 is provided with engaging portions 30 on both sides thereof (only one is visible), the copier upper unit 22 is provided with rails 28 on both sides thereof (only one is visible). The unit 10 is moved deeper into the copier 20 with its engaging portions 30 mated with the rails 28, which have the been rotated by a predetermined angle. Subsequently, as shown in FIG. 3, the copier upper unit 26 is lowered onto the copier lower unit 22, whereby the unit 10 is loaded in a predetermined position inside of the copier body 20.

Figure 3:
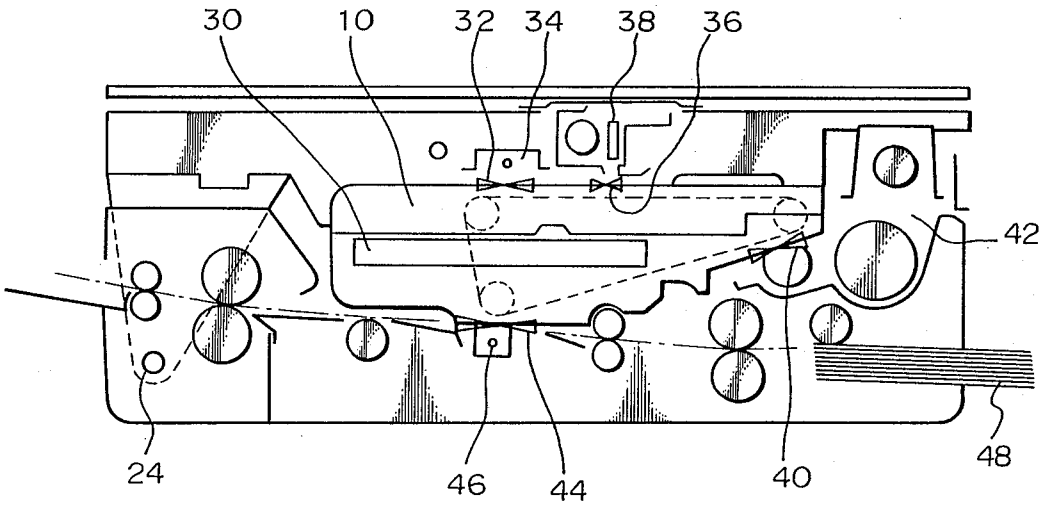

In the position shown in FIG. 3, openings 32, 36, 40 and 44 which are formed through the casing 12 face, respectively, a charger 34, an imaging device 38, a developing roller (no numeral), and a transfer charger 46. The charger 34 is rigidly mounted on the copier upper unit 22, and the developing roller is provided in a developing device 42 which is mounted on the copier lower unit 26. Under this condition, the belt 14 faces the various processing units adapted to form an image. A toner image provided on the belt 14 is transferred by the transfer charger 46 to a paper which is fed from a paper feed section 48 through the opening 44. A grid 34a, FIG. 1, is provided in the opening 32 to allow the charger 34 to charge the belt 14 uniformly.

Figure 4:
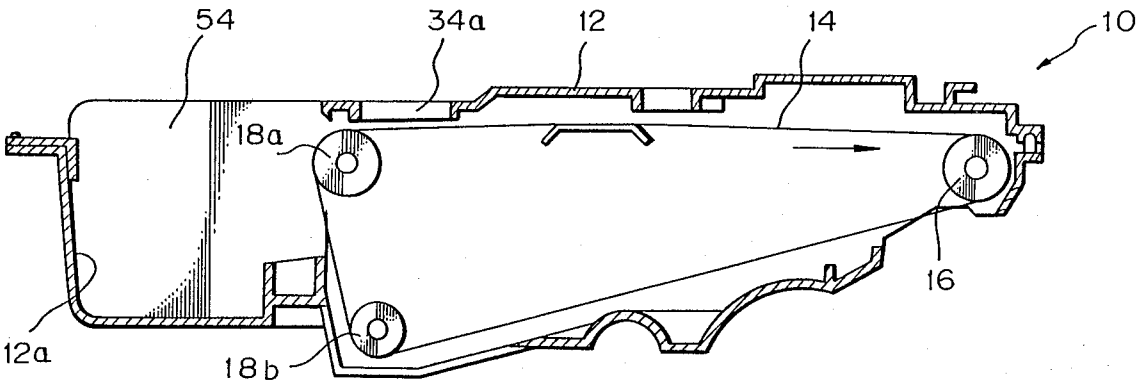
FIG. 4 is a section of a photoconductive element unit from which a cleaning device has been removed.

A cleaning device 50 is housed in a mounting section **12*a*, which is provided in a left portion of the casing 12, removably and in contact with the belt 14. As shown, the cleaning device 50 includes a blade for removing toner which remains on the belt 12 after image transfer, and a container for collecting the removed toner. FIG. 4 shows the photoconductive element unit 10 from which the cleaning device 50** has been removed.

Figure 5:
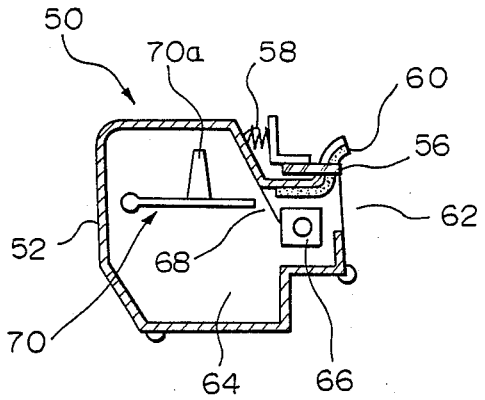
FIG. 5 is a section of the cleaning device.

Referring to FIG. 5, the cleaning device 50 which is removed from the photoconductive element unit 10 is shown in a section. Those portions of the cleaning device mounting section **12*a* which make contact with the outer surfaces of a casing 52 of the cleaning device 50 are provided with a seal 54, FIG. 4, so that toner may be prevented from leaking and falling downward from the cleaning device 50 when the device 50 is put into and out of the mounting section 12a. Especially, at a position where the casing 52 faces the belt 14, the end portions of the sela 54 are held in or substantially held in contact with the photoconductive element 14 to prevent the toner from falling through the opening 44. The seal 54** is implemented with, for example, a polyurethane sheet or a polyester film and usually provided with a thickness of 0.05 to 0.3 millimeter.

Figure 6:
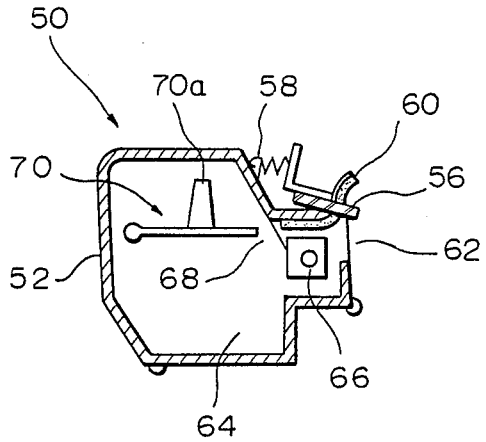
FIG. 6 is a section showing the movement of a cleaning blade which is included in the cleaning device.

In FIG. 5, the reference numeral 56 designates a cleaning blade. As shown in FIG. 1, when the cleaning device 50 is loaded in the photoconductive element unit 10, the free end or tip of the cleaning blade 56 is caused by a spring 58 to press itself against the outer periphery of the belt 14 with an adequate force. Seals 60 made of sponge or the like are provided at both sides of the cleaning blade 56 to check the toner removed by the blade 56 from the belt 14, which would otherwise escape to the outside. Positioned just below and along the belt 14 is a seal 62 which is adapted to prevent the toner from falling. The seal 62 is spaced from the blade 56 by a gap when the cleaning device is 5 is mounted on the photoconductor element unit 10 for permitting entry of developer. As shown in FIG. 6, while the cleaning device 50 is moved out of the photoconductive element unit 10, the tip of the cleaning blade 56 is displaced downward by the action of the spring 58 until it makes or almost makes contact with the upper end of the seal 62. This closes or at least reduces the gap between the tip of the blade 56 and that of the seal 62 and, thereby, eliminates or at least reduces the leakage of toner through that opening.

A rectangular rod 66 is located just below the cleaning blade 56 and rotatable as indicated by an arrow to transport the removed toner into a bore, or collecting section, of the cleaning device 50. The toner adhered to and transported by the rod 66 is scraped off by a scraper 68 to be stored in the collecting section 64. As the toner fills the bore 64, it sequentially urges a feeler 70 upward until one end **70*a* of the feeler 70 is caused to protrude from the top wall of the casing 52 through an opening of the latter, as shown in FIG. 1. A sensor 72 which is mounted on the copier body 20, e.g., a photosensor senses the end 70*a* of the feeler 70, activating a display for informing such an occurrence. To prevent the toner from escaping through the opening of the casing 52 through which the feeler 70 protrudes, that opening is sealed by a rubber film or like seal which is thin enough to accommodate the movement of the feeler 70. The casing 52 of the cleaning device 50 is readily removable from the unit casing 12 when the bore 64 is filled up, when the cleaning blade 56** is deteriorated, or in the event of service.

So long as the amount of toner expected to be collected before the life of the cleaning blade 56 expires and the volume of the container are held in correspondence, all that is required is replacing the cleaning device 50 when the sensor 72 shows the full condition of the toner collecting section 64. This not only allows one to readily see the timing for replacing the cleaning device but also eliminates the waste of resources. Specifically, since the life of the cleaning blade 56 and that of the toner containing section 64 expire at the same time, it is not wasteful to discard them simultaneously at all.

Even if the last replacement of the belt 14 and that of the cleaning device 50 are not coincident, one can be informed of the life of the belt 14 by the deterioration of image quality as well as the cumulative copy number and, therefore, can readily decide which one of them should be replaced.

The life of a cleaning device is shorter than that of a photoconductive element. A cleaning device is replaced more than once before the life of a photoconductive element expires and, from the economic standpoint, it should be replaced twice, three times or more. However, the gist is that if the life of a photoconductive element is 1.5 times longer than that of a cleaning device, i.e., if the life of a cleaning device is less than $\frac{2}{3}$ of the life of a photoconductive element, the second replacement of a cleaning device may be effected simultaneously with the replacement of a photoconductive element without entailing any noticeable loss in the economic aspect. This is because a cleaning device is less expensive than a photoconductive element.

Hereinafter will be described another specific construction of the cleaning device 50 and cleaning device mounting section **12*a***.

Figure 7:
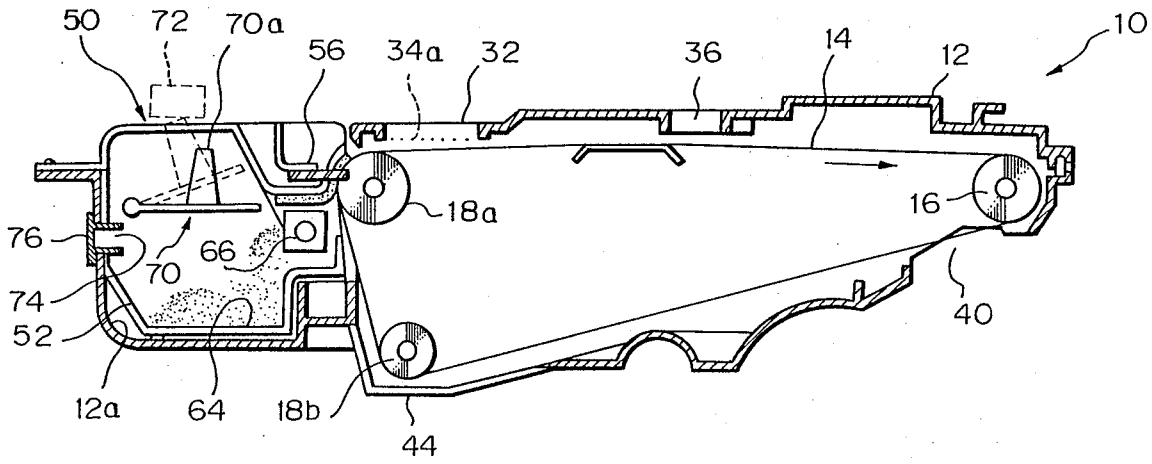
FIG. 7 is a section of a photoconductive element in accordance with another embodiment of the present invention.

As shown in FIG. 7, each of the cleaning device 50 and the mounting section **12*a* of the photoconductive element unit 10 is provided with an opening 74 through, for example, its side wall. A closure member 76 made of rubber of soft plastic is elastically plugged in the opening 74 to close it. In this construction, when the sensor 72 informs a person that the toner collecting section 64 of the cleaning device 50 has been filled up, the person may remove the photoconductive element unit 10 from the copier body 20, then remove the closure member 76** from the opening 74, then discard the toner collected in the toner collecting section 64, and then put the unit 10 in the copier body 20 again. The cleaning device 50 with the toner collecting section 64 is then prepared for reuse.

While the present invention has been shown and described in relation to a photoconductive belt, it is also applicable to a photoconductive unit which is provided with a cleaning device integrally therewith.

As described above, in accordance with the present invention, a cleaning device is housed in a single casing and bodily removable from a photoconductive element unit. In this configuration, it is not necessary for the size of the cleaning device to be increased despite the tendency toward a long-life photoconductive element in the imaging art. Conversely, when the photocondcutive element is scratched or otherwise damaged, a toner container and a cleaning blade of the cleaning device do not have to be discarded and can be reused, cutting down the running cost of an image-forming apparatus.

Further, even though the amount of toner to be collected before the life of a photoconductive element expires may be increased due to the above-stated tendency in the art, the toner collected can be disposed of every time the toner collecting section becomes full. This eliminates the need for the replacement or disposal of the whole photoconductive element unit and allows the photoconductive unit to be used till the end of the life of the photoconductive element, offering an unprecedented economic advantage.

Various modifications will become possible for those skilled in the art after receiving the teachings of the present disclosure without departing from the scope thereof.

What is claimed is:

1. A photoconductive element unit removably mounted in an image-forming apparatus, comprising:

a rotatable photoconductive element; and a cleaning device comprising a cleaning means for removing a developer which remains on said photoconductive element after transfer of an image, and a developer collecting means for collecting the developer which is removed by said cleaning means;

said cleaning means being removably mounted in the photoconductive element unit;

wherein said cleaning means comprise a cleaning blade movably held in said cleaning device, a seal member position in said cleaning device such that a gap is formed between said seal member and said blade when said cleaning device is mounted in said photoconductor element unit for permitting entry of developer into said cleaning device, and means for moving said cleaning blade so as to reduce the size of said gap when said cleaning device is removed from said photoconductor element unit, whereby developer leakage is minimized.

2. A photoconductive element unit as claimed in claim 1, further comprising cleaning device mounting means for mounting the cleaning device in the photoconductive element unit.

3. A photoconductive element unit as claimed in claim 2, wherein the cleaning device mounting means comprises a part of a casing in which the photoconductive element is loaded and housed.

4. A photoconductive element unit as claimed in claim 3, wherein the cleaning device mounting means further comprises a seal member provided in a part of the casing with which the cleaning device makes contact.

5. A photoconductive element unit as claimed in claim 4, wherein end portions of the seal member make contact with or adjoin a surface of the photoconductive element.

6. A photoconductive element unit as claimed in claim 1, the developer collecting means of the cleaning device comprises a container having a predetermined volume.

7. A photoconductive element as claimed in claim 1, wherein the life of the cleaning unit is shorter than the life of the photoconductive element.

8. A photoconductive element as claimed in claim 7, wherein the life of the cleaning unit is less than $\frac{2}{3}$ of the life of the photoconductive element.

9. A photoconductive element unit as claimed in claim 1, wherein the developer collecting means has a volume which substantially corresponds to an amount of developer which is to be collected before the life of the cleaning means expires.

10. A photoconductive element unit as claimed in claim 1, wherein the photoconductive element comprises an endless belt.

11. A photoconductive element unit as claimed in claim 1, wherein the photoconductive element comprises a rotary drum.

12. A photoconductive element unit as claimed in claim 1, wherein the developer comprises toner.

13. A photoconductive element unit as claimed in claim 1, wherein said means for moving said cleaning blade comprise a spring.

14. A photoconductive element unit removably mounted in an image-forming apparatus, comprising:

a rotatable photoconductive element; and a cleaning device comprising a cleaning means for removing a developer which remains on said photoconductive element after transfer of an image, and a developer collecting means for collecting the developer which is removed by said cleaning means;

said cleaning means being removably mounted in the photoconductive element unit;

wherein the developer collecting means of the cleaning device comprises a container having a predetermined volume, and wherein the container is provided with an opening for removing the developer collected, the developer collecting means further comprising a closure member for plugging said opening.

15. A photoconductive element unit removably mounted in an image-forming apparatus, comprising:

a rotatable photoconductive element; and a cleaning device comprising a cleaning means for removing a developer which remains on said photoconductive element after transfer of an image, and a developer collecting means for collecting the developer which is removed by said cleaning means;

said cleaning means being removably mounted in the photoconductive element unit;

wherein the developer collecting means of the cleaning device comprises a container having a predetermined volume, and wherein the cleaning device further comprises sensor means for sensing that the container is filled up.

* * * * *